United States Patent [19]

Dickey

[11] Patent Number: 4,813,799

[45] Date of Patent: Mar. 21, 1989

[54] DOCUMENT PRINTING AID FOR MICROCOMPUTER PRINTERS

[76] Inventor: Joan D. Dickey, P.O. Box 133, Moss Beach, Calif. 94038-0133

[21] Appl. No.: 184,381

[22] Filed: Apr. 21, 1988

Related U.S. Application Data

[63] Continuation of Ser. No. 837,750, Mar. 10, 1986, abandoned.

[51] Int. Cl.[4] ..... B41J 13/12

[52] U.S. Cl. ..... 400/522; 400/523; 400/525

[58] Field of Search ..... 400/521, 522, 525, 523, 400/535, 544, 531

[56] References Cited

U.S. PATENT DOCUMENTS

| | | | |
|---|---|---|---|
| 916,196 | 3/1909 | Rand | 400/525 |
| 1,342,174 | 6/1920 | Labofish | 400/521 |
| 1,730,445 | 10/1929 | Barney | 400/521 X |

FOREIGN PATENT DOCUMENTS

| | | | |
|---|---|---|---|
| 1561246 | 3/1970 | Fed. Rep. of Germany | 400/521 |

OTHER PUBLICATIONS

IBM Tech. Discl. Bulletin, "Card Feed Apparatus", Hunt, vol. 26, No. 12, May 1984, pp. 6537-6538.

*Primary Examiner*—David A. Wiecking
*Assistant Examiner*—James R. McDaniel
*Attorney, Agent, or Firm*—Niro, Scavone, Haller, Niro & Rockey, Ltd.

[57] ABSTRACT

The invention is a document printing aid for microcomputer printers. The invention includes a flexible mask of material, larger than the document to be printed, with an outline of the document on the face of the mask. The printing aid is inserted into a microcomputer printer. The document is placed behind the printing aid and is aligned with the outline. The document, held between the printing aid and roller, is positioned for printing. Apertures in the printing aid allow the printing element to contact the document.

3 Claims, 1 Drawing Sheet

FIG. 1
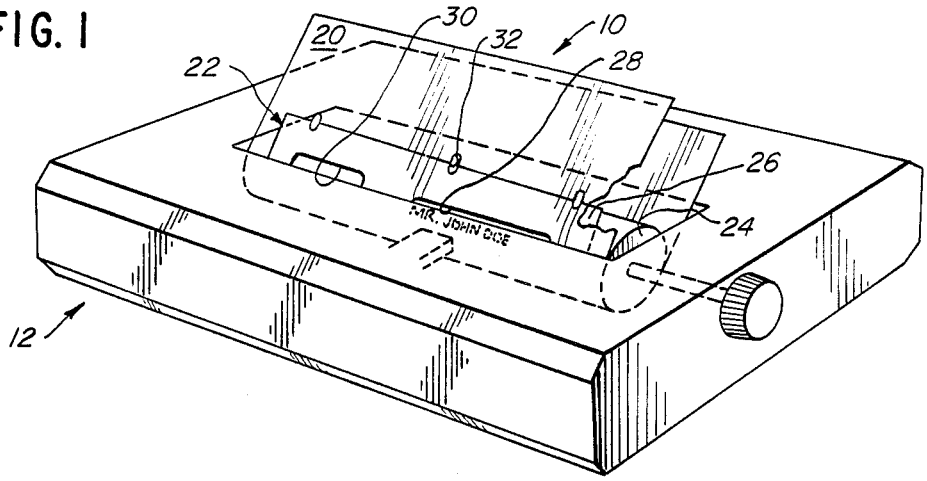
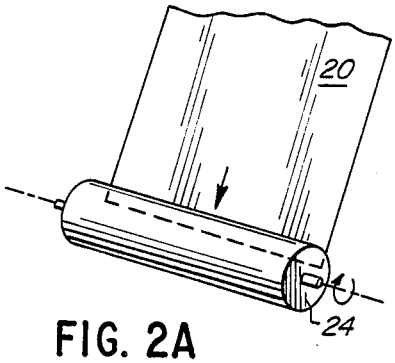
FIG. 2A
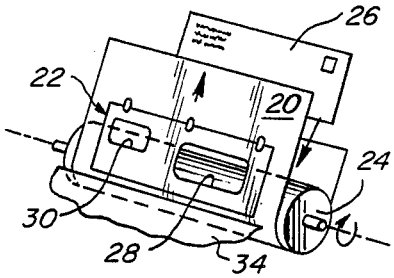
FIG. 2B
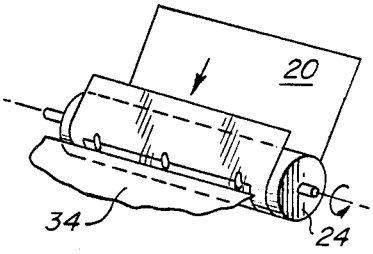
FIG. 2C
FIG. 3
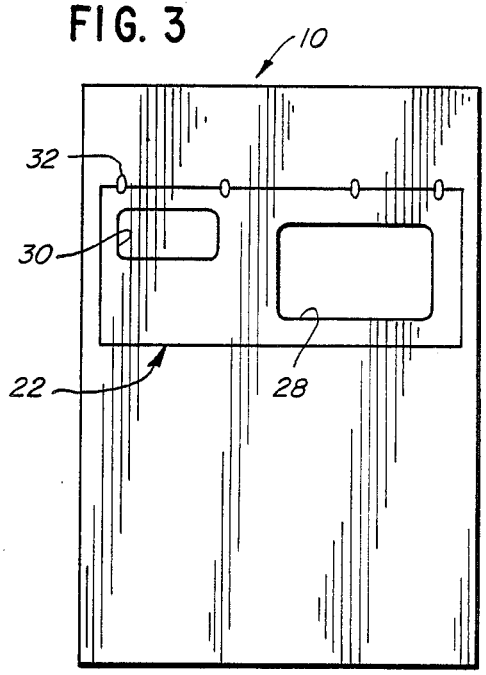
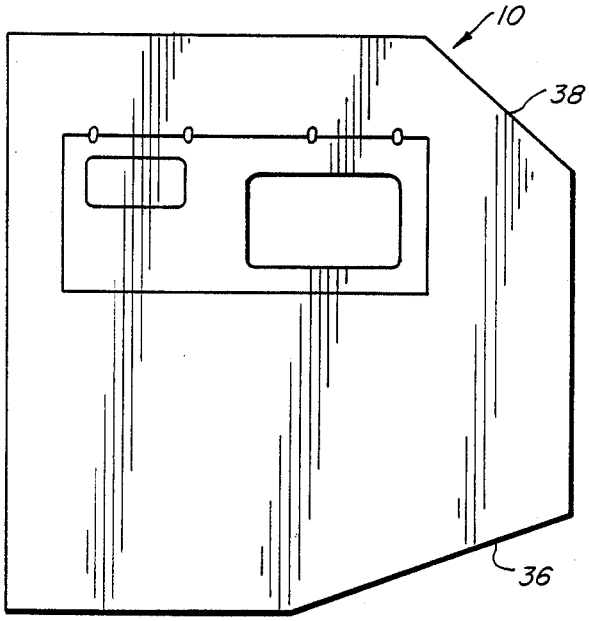
FIG. 4

DOCUMENT PRINTING AID FOR MICROCOMPUTER PRINTERS

This is a continuation of co-pending application Ser. no. 837,750 filed on 03/10/86, now abandoned.

BACKGROUND OF THE INVENTION

The invention is directed to a document printing aid for microcomputer printers.

The advent of microcomputers has allowed individuals to store, process and manipulate large amounts of complex data at speeds heretofore unknown. In order to make best use of the advantages of the microcomputer, it is frequently necessary or desirable to produce the results of a computer operation in printed form. The printed information can then be read, analyzed, and transmitted to others for their use. Printers have been developed to allow the transfer of information from a microcomputer memory into printed form. These printers frequently emphasize high speed, and use special paper designed to feed rapidly into the printer.

However, the advantages of high-speed computer processing and printing are substantially negated when printing non-standard documents which cannot be automatically fed into available microcomputer printers. Computer printers are not well-suited to holding and printing non-standard documents because such documents are often narrower than the width of the printer platen or roller, which reduces the pressure exerted on the document by the printer paper bail and prevents engagement of the document with paper feeding mechanisms. Because of their size and shape, such non-standard documents frequently do not advance properly. Consequently, printing may be tilted, misaligned, or improperly spaced. This negates a significant advantage of computer printers, which is to achieve legible and professional printing. In order to obtain good quality, documents must be frequently adjusted. This negates the high-speed advantage of the microcomputer.

The prior art discloses typewriter or computer printing aids. However, some of these aids employ pockets. See, for example, U.S. Pats. Nos. 1,480,440 and 2,034,730. Other devices use adhesive strips. See, for example, U.S. Pat. No. 4,448,558.

For these reasons, it is desirable to provide a simple means of enabling microcomputer printers to rapidly print non-standard documents, and to achieve high quality in doing so. It is also desirable to avoid complicated construction or the use of adhesives which may have a limited life.

SUMMARY OF THE INVENTION

The present invention preserves all the advantages of available microcomputer printers. It also provides new advantages not currently available, and overcomes some of the inherent disadvantages of presently available microcomputer printers. The invention is directed to a document printing aid for a microcomputer printer. The invention includes structural features which permit the user to achieve high-quality printing of non-standard documents at a greatly increased rate.

In the preferred embodiment, the invention consists of a mask of flexible material equal in width to the platen or roller of a microcomputer printer. An outline of the document to be printed is marked on the surface of the flexible material. The material contains apertures to allow contact between the printing element and the document to be printed. A series of small alignment holes is placed along the top edge of the document outline to permit the user to see the top edge of the document when it is placed between the flexible material and the printer roller. For wide carriage printers, the upper and lower corners on one side of the flexible material may be tapered to facilitate placing a document behind the material.

The printing aid is inserted into a printer from the rear and is long enough to provide good frictional engagement with the printer roller. The printing aid is rolled forward, exposing the document outline. A document is placed behind the printing aid. The printing aid is rolled back, positioning the document for printing. The large surface of the aid, the document outline, and the alignment holes accomplish the objects of the invention, which are to allow a great increase in speed while insuring high quality printing. Furthermore, the aid is extremely simple to make.

DESCRIPTION OF THE DRAWINGS

The novel features which are characteristic of the present invention are set forth in the claims. The invention itself, however, together with further objects and attendant advantages, will be best understood by references to the description taken in connection with the accompanying drawings in which:

FIG. 1 is a perspective view of a microcomputer printer employing the present invention.

FIG. 2A, 2B, and 2C are perspective views depicting the manner in which the invention is used. Except for the printer roller, the printer has been deleted for clarity.

FIG. 3 is a plan view of an embodiment of the invention suitable for use with a small carriage printer.

FIG. 4 is a plan view of another embodiment of the invention suitable for use with a large carriage printer.

DESCRIPTION OF THE PREFERRED EMBODIMENT

The present invention, designated generally as document printing aid 10 in FIG. 1, may be employed with any microcomputer printer 12, also shown in FIG. 1. Referring simultaneously to FIGS. 1, 2, and 3, the document printing aid consists of a rectangular mask of flexible material 20. One type of material which has been found to be suitable is spun-bonded polyethylene fiber. The material must be sufficiently flexible to be received around a platen of a microcomputer printer 12. The mask 20 is equal in width to the paper normally employed in the printer 12. Mask 20 has a document outline 22 printed on the surface of mask 20 away from a platen or roller 24 of printer 12. Document outline 22 is the same size as a document 26 to be printed. In FIGS. 1 and 2, document 26 is depicted as an envelope. Of course, many kinds of documents can be printed, including envelopes, postcards, invitations, name labels, mailing labels, index cards, removable file cards for address files, business cards, checks, etc., and document outline 22 can be varied accordingly.

Mask 20 contains two apertures 28 and 30. Apertures 28 and 30 allow a printing element (not shown) of printer 12 to make contact with document 26, thus printing document 26. In the embodiment shown in FIG. 3, aperture 28 is suitable for an address and aperture 30 is suitable for a return address. Again, the number, size, and location of apertures may be altered depending on the nature of document 26 and the desired printing. A plurality of alignment slots 32 in mask 20 may be located along the top edge of document outline 22. Slots 32 enable the user to ensure the proper positioning of document 26 prior to instructing the microcomputer to print the document.

Turning now to FIG. 2, the document printing aid 10 is inserted behind roller 24 of a microcomputer printer which is deleted for clarity. Roller 24 is rolled to advance the document printing aid 10 until the bottom edge of document outline 22 is above a paper bail 34 shown in FIGS. 2B and 2C. Document 26 is then placed behind printing aid 10. Roller 24 is then rolled in the opposite direction until the top edge of aperture 28 is at the edge of paper bail 34, as shown in FIG. 2C. The top of aperture 30 is slightly higher than that of aperture 28 to allow the printing element (not shown) to contact document 26 and print a return address above and to the left of the principal address. Proper alignment of document 26 is verified by visual inspection through alignment slots 32. The microcomputer is then instructed to print through apertures 28 and 30. Roller 24 is again rotated automatically or manually (depending on the software used) to position document outline 22 above bail 34, and a new blank document 26 is exchanged for the printed one.

Experimentation with the present invention with envelope printing has shown that production increases by a factor of two and one-half to three times the rate achievable without the invention. Furthermore, the rejection rate of unsatisfactorily printed envelopes has been reduced from a range of five to eight per cent to approximately three-tenths of one per cent. Thus, the invention accomplishes both desired objects - a dramatic increase in speed while maintaining high quality.

FIG. 4 shows an alternative embodiment of document printing aid 10 suitable for use with larger carriage printers. Mask 20 has tapered corners 36 and 38. Tapered corner 36 allows easier insertion of a document behind printing aid 10. Tapered corner 38, in cooperation with tapered corner 36, allows the operator to easily reach behind printing aid 10. Such access is useful if, for example, the supply of documents to be printed is stacked on printer 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A document printing aid for use with a microcomputer comprising:

material consisting of a single layer, no wider than a platen in a computer printer, and flexibly received around the platen;

a document outline guide on the surface of the layer away from the platen;

at least one aperture in the layer, located within the document outline, for exposing a document, supported between the layer and platen, to the printing element of the computer printer; and a plurality of slots to align the document to be printed with the platen.

2. The document printing aid of claim 1, the layer of material being rectangular.

3. The document printing aid of claim 2, the rectangular layer further having a tapered corner to facilitate insertion of a document between the layer and the platen.

* * * * *